US008506031B2

(12) United States Patent
Abergel

(10) Patent No.: US 8,506,031 B2
(45) Date of Patent: Aug. 13, 2013

(54) INK JET PRINTER AND METHOD FOR DEPOSITING A PROTECTIVE LAYER ON A SUBSTRATE

(75) Inventor: Edmond Abergel, Paris (FR)

(73) Assignee: M.G.I. USA, Inc., Melbourne, FL (US)

( * ) Notice: Subject to any disclaimer, the term of this patent is extended or adjusted under 35 U.S.C. 154(b) by 208 days.

(21) Appl. No.: 12/649,765

(22) Filed: Dec. 30, 2009

(65) Prior Publication Data

US 2010/0165024 A1 Jul. 1, 2010

(30) Foreign Application Priority Data

Dec. 30, 2008 (FR) ..... 08 07500

(51) Int. Cl.
*B41J 2/01* (2006.01)

(52) U.S. Cl.
USPC ..... 347/10

(58) Field of Classification Search
CPC ..... B41J 2/04563; B41J 2/04588
USPC ..... 347/5–7, 9–11, 14, 17, 19, 68
See application file for complete search history.

(56) References Cited

U.S. PATENT DOCUMENTS

| | | | | |
|---|---|---|---|---|
| 4,743,924 | A | 5/1988 | Scardovi | |
| 5,502,467 | A * | 3/1996 | Hoisington et al. | 347/6 |
| 7,018,459 | B2 * | 3/2006 | Doi et al. | 106/31.6 |
| 7,226,141 | B2 * | 6/2007 | Asano et al. | 347/10 |
| 7,279,506 | B2 | 10/2007 | Sisler et al. | |
| 7,332,037 | B2 | 2/2008 | Abergel et al. | |
| 7,451,698 | B2 | 11/2008 | Schneider et al. | |
| 7,543,899 | B2 * | 6/2009 | Konno | 347/6 |
| 7,614,725 | B2 | 11/2009 | Schulmeister | |
| 2004/0189732 | A1 | 9/2004 | Usuda | |

FOREIGN PATENT DOCUMENTS

| | | |
|---|---|---|
| EP | 1186410 | 3/2002 |
| EP | 1621260 | 2/2006 |
| EP | 1749670 | 2/2007 |

* cited by examiner

*Primary Examiner* — An Do
(74) *Attorney, Agent, or Firm* — Lowe Hauptman Ham & Berner, LLP

(57) ABSTRACT

A protective layer is applied to a substrate moving relative to an ink jet nozzle array. Each nozzle responds to a piezoelectric actuator. Shapes of ink droplets deposited by the nozzles on the substrate, to form the protective layer, are controlled by shapes of electric waveforms applied to the actuators. Shapes of the waveforms respond to at least one of: droplet viscosity and temperature, temperature of the substrate, desired thickness of the layer, type of substrate surface to which the droplets are applied, and relative speed of the substrate and the ink jet nozzle array.

25 Claims, 2 Drawing Sheets

INK JET PRINTER AND METHOD FOR DEPOSITING A PROTECTIVE LAYER ON A SUBSTRATE

RELATED APPLICATION

The present application is based on, and claims priority from, FR Application Number 08 07500, filed Dec. 30, 2008, the disclosure of which is hereby incorporated by reference herein in its entirety.

FIELD OF INVENTION

The present invention relates to ink jet printers and methods for depositing a protective layer on a substrate and more particularly to such a printer and method wherein a voltage waveform particularly adapted to the ink is applied to a piezoelectric actuator for an ink jet nozzle arrangement. The protective layer is formed from a material referred to herein as a varnish is or ink.

BACKGROUND ART

During printing, ink is deposited on the surface of a substrate, made, for example, of paper or plastic. It is then common to cover the printed surface of the substrate with a protective layer. This protective layer completes the fixation of the printed image on the substrate while protecting the print against certain external aggressions such as projections, and/or light, heat and humidity. The protective layer is typically formed of an ink like material that enables creation of different visual effects by printing the ink like material as patterns on certain areas. Deposition of this protective layer on a printed substrate is generally performed by flexographic, offset, screen printing. It is also possible to customize the protective layer by causing some areas of the substrate to have varnish patterns and other areas to not have any varnish.

Patent application EP 1749670 relates to a digital ink jet machine for to laying a coating with medium viscosity on a variable coating substrate by using ink jet nozzles including hollow needles set into vibration by a piezoelectric actuator adhesively bonded to a resonator including an assembly of the hollow needles. The size and the shape of a droplet of material (i.e., an ink or varnish) deposited by each nozzle on the surface of the substrate, depend on the duration and amplitude of an electric wave driving the actuator. However, such a device, if it is able to deposit varnish drops with medium or high viscosities (which are of the order of about a thousand centipoises), is not suitable for optimum ejection of varnishes with much lower viscosity.

A goal of the present invention is to overcome one or more drawbacks of the prior art by providing a suitable device for optimal deposition of a protective ink layer on a surface of a substrate independently of the ink viscosity and the substrate to be covered.

SUMMARY OF THE INVENTION

An aspect of the invention relates to a method of applying a protective layer to a substrate moving relative to an ink jet nozzle arrangement having a piezoelectric actuator, wherein the ink jet nozzle arrangement applies to the substrate ink droplets that form the protective coating. The method comprises controlling the shapes of the droplets by controlling the shape of an electric waveform applied to the piezoelectric actuator. The shape of the electric waveform is controlled in response to at least one of the following parameters: viscosity of the ink droplets, temperature of the ink droplets, temperature of the substrate, desired thickness of the layer, type of substrate surface to which the droplets are applied, temperature of the substrate, and relative speed of the substrate and the ink jet nozzle array.

Another aspect of the invention relates to an apparatus for applying a protective layer to a substrate, wherein the apparatus comprises an ink jet nozzle arrangement having a piezoelectric actuator, and a transport mechanism for causing relative movement between the substrate and the ink jet nozzle arrangement. The ink jet nozzle arrangement is arranged for applying to the substrate droplets that form the protective coating. An electric source applies an electric waveform to the piezoelectric actuator. The waveform is arranged for controlling the shapes of the droplets. The electric source is arranged so the electric waveform has a shape determined by at least one of the following parameters: viscosity of the ink droplets, temperature of the ink droplets, temperature of the substrate, desired thickness of the layer, type of substrate surface to which the droplets are applied, temperature of the substrate, and relative speed of the substrate and the ink jet nozzle arrangement.

In one embodiment, a first polarity portion of the waveform has a rising portion with one or more intermediate plateaus, between a neutral portion of the waveform, where the nozzle is at rest, and a maximum plateau of the waveform where ink is expelled from the nozzle. The amplitude and duration of the intermediate plateau are determined by the ink viscosity. In another embodiment, the rising waveform portion has a duration and amplitude having an increasing continuous progression.

A memory of a control computer for the apparatus preferably includes at least one data base correlating at least one predefined temperature of the ink applied to the nozzle with the ink viscosity and/or with the composition of the ink to be deposited.

One type of ink includes a polymer photoinitiator, in which case a UV lamp is positioned downstream of the nozzles, to derive UV radiation that is incident on the ink applied to the substrate and having a wavelength and intensity to activate the photoinitiator.

Preferably an infrared drying lamp arrangement is positioned (1) to face the substrate and (2) upstream of the UV lamp to pre-dry and stretch ink deposited on the substrate. The optimum distance between the ink jet nozzles and the UV source depends on characteristics of the substrate and/or the composition of the deposited varnish.

At least one wavelength of the infrared lamp provides a pre-drying of the ink and optimum stretching of the ink on the substrate, depending on the characteristics of the substrate and/or the composition of the deposited ink.

Preferably, there are at least two infrared lamps for emitting IR radiation in different wavelength ranges. The respective power of each of the lamps is controlled and monitored by a device for managing a combination of radiations from the infrared lamps that pre-dry depending on the substrate on which the ink is deposited and/or on the composition of the deposited ink.

The substrate can be displaced before reaching at least one infrared lamp so the substrate is a determined distance from the at least one IR lamp, based on the substrate speed, the type of substrate on which the ink is deposited and/or of composition of the deposited ink.

It is also possible to provide a system for correcting at least one lateral shift of the printing by the device.

The invention with its characteristics and advantages will become more clearly apparent upon reading the description made with reference to the appended drawings.

DETAILED DESCRIPTION OF THE DRAWING

In the present document, the terms of "covering ink", "viscous product" and "varnish" are synonyms.

Figure 1:
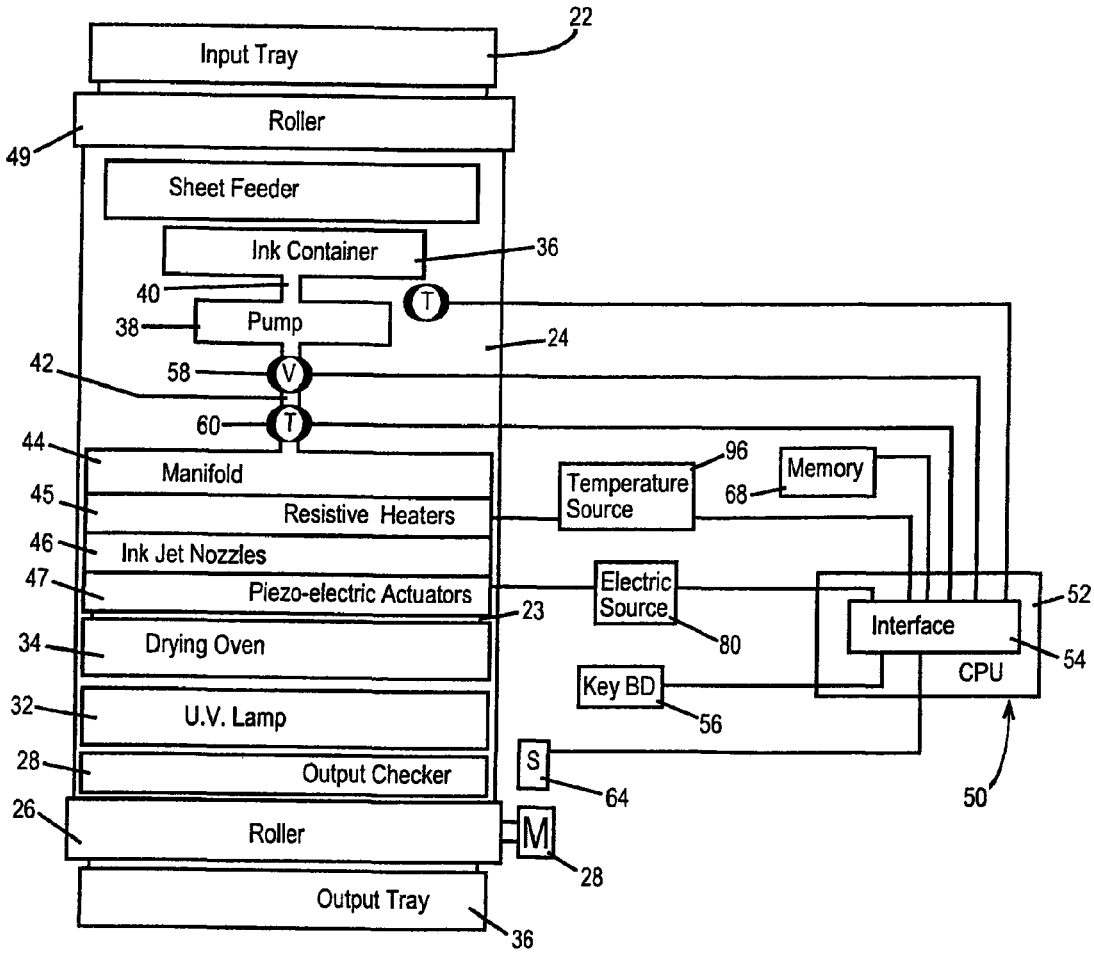
FIG. 1 is a top schematic view of a preferred embodiment of an ink jet device for applying a protective layer to a substrate.

The apparatus of FIG. 1 is a printing device for depositing ink from ink container 36 onto the surface of substrate 23 independently of the viscosity of the ink. The deposited ink forms a protective layer for the substrate.

The printing device is controlled by computer 50 which controls different work stations and collects information from various sensors. These sensors, for example, provide information about the position of the substrates, information about the configuration of the substrates and validation information indicating whether an operation was properly or improperly performed, as well as conditions (particularly viscosity and temperature) of the ink. Computer 50 includes CPU 52 having interface 54 responsive to (1) key board 56 and (2) sensors 58 and 60 for the viscosity and temperature of the varnish flowing from container 36, respectively, as well as sensors 62 and 64 for the temperature and forward speed of substrate 23, respectively. Computer 50 also includes memory 66 which responds to signals gathered by interface 54 to derive various control signals that are supplied to the CPU, thence via interface 54 to various actuators and controllers.

The substrates awaiting printing (i.e., to have a protective layer deposited thereon) are placed in an input tray 22 having a capacity based on the nature of the substrate and to the printing needs. In an exemplary embodiment, the input tray 22 accepts (at one time) several thousand substrates, each having a thickness up to 800 μm and variable sizes, for example between the format of a credit card up to an AO format, and possibly including at least one face which is plastic. After the protective layer has been deposited, the substrates are stored in output tray 36, generally having the same capacity as the input tray. A device (not shown) for gripping the substrates extracts the substrates (e.g., substrate 23) from input tray 22 and positions the substrates on a conveyor belt 24 which is driven longitudinally by roller 26, in turn driven by motor 28 to displace the substrates along a working chain including several work stations.

The first work station is a sheet feeder 49 which indexes the substrate to position two reference edges relative to each other or for detecting a mark printed on the substrate. A sensor detects the information on positions and transmits the information to computer 50 via a wired or wireless network. This information stored in memory 66 is then be reused at other work stations driven by computer 50. Inspections are also carried out in order to detect the presence of a single substrate at each station of the conveyer.

The second work station 70 projects the ink which forms the protective layer on substrate 23. Second work station 70 includes ink container 36, pipes 40 and 42 and pump 38 for supplying the ink or varnish in container 36 under pressure to manifold 44 which distributes the ink to ink jet nozzles of nozzle array 46. Each nozzle of nozzle array 46 includes a passageway containing one of resistance heaters 45 and is vibrated by its individual piezoelectric actuator of actuator array 47. Manifold 44, nozzle array 46 and actuator array 47 extend between opposite edges of substrate 23 to enable the ink to form a protective coating across the entire width of the substrate. Alternatively, at a particular time, only some or none of actuators 47 apply energy to only some or none of the nozzles of array 46, as substrate 23 is moving past the nozzles, in which case, a protective coating is formed on only a portion or portions of the substrate aligned with the nozzles that are responsive to energy from actuators 47. The centers of the nozzles of array 46 are typically spaced from each other by one tenth to several thousandths of a millimeter, preferably between 0.01 and 0.1 mm.

Non-limiting examples of inks in container 36 are varnish, scratch-off ink, conducting ink, printing ink or adhesive with typical average viscosities in the range of 100 to 1,000 centipoises, but which may have viscosities as low as about ten centipoises. Container 36 may be fed, for example, manually or automatically by a feeding circuit or semi-automatically by a device controlled by an operator. The outlet of container 36 is connected in fluid flow relation by pipe 40 to a pressurization device (pump) 38 which applies sufficient pressure to the material flowing from container 36 to nozzles 46 to enable the nozzles to operate properly. The pressurization device 38 therefore includes a detector (not shown) for monitoring and regulating the pressure of the ink sent towards nozzle 46; computer 50 can be part of this pressure regulation.

The area covered by the ink droplets is defined for each substrate by a parameterization file contained in memory 66 of computer 50. The file contains data relating to the shape of the substrate area to be covered, the position on the substrate relative to the marks on the substrate, and the amount of ink to be projected in each droplet. Memory 66 also has a software package for controlling the machine of FIG. 1 so the machine can exploit this information, and for expressing this information in parameters indicative of relative displacement of the substrate 23 and nozzle array 46, and of selective control of the nozzles of array 46, e.g., to control the shapes of the droplets, and of reiteration of the shifted passage of substrate 23 in front of nozzles of array 46 in order to produce joined lines if required.

Downstream of the projection station 70 is drying station or oven 34. Drying station 34 completely or partly dries the ink projected onto substrate 23 by nozzle array 46. The drying, depending on the applied ink, is achieved with infrared radiation in the case of an aqueous varnish or with a stream of heated air for an adhesive or a scratch-off ink or with UV depending on the projected ink. After substrate 23 has been dried, some substrates are transferred to output tray 36, without the projected ink being transferred to other substrates or on the tray with which the substrate is in contact.

A protective varnish layer can be applied to a face of the substrate before or after printing. A protective varnish layer can, for example, occupy a quasi rectangular area on the substrate, the corners of which are rounded. A margin not covered with the protective layer can be left on the perimeter of the face of the substrate. A thermally re-activatable adhesive layer can be applied to an area of a substrate, according to a pattern that is, for example, to a small rectangle rounded at its corners. Various patterns of scratch-off ink can be laid on other areas, and have various shapes, such as an arrow, a star or any other pattern including, in a non-limiting way, a contour formed of angles and straight and/or curved lines.

Two machines of the type illustrated in FIG. 1 can be provided for applying protective layers to different faces of a single substrate. One of the machines can be before printing, the other after printing. The ink containers of these two machines can be loaded with suitable inks so various patterns can be made on both faces of a substrate. These print materials are, for example, printed on areas protected by a varnish, a scratch-off ink or sized areas or a combination of these various possibilities on any face. Printing on the various faces is achieved by a reversal mechanism between a machine and the following or preceding machine.

With the piezoelectric control, it is possible to adjust the duration and intensity of the ink projected by nozzles of array 46 onto substrate 23. The protected areas are specified by data loaded into memory 66, which in turn activates interface 54 that controls piezoelectric actuator array 46 and nozzle array 46 to provide a digital process having accuracy of the order of 0.05 mm. The protective layer may therefore cover only a point or the whole surface of a substrate. The area of the protected layer is defined for each substrate by a file in memory 66 relating to the shape of the area, its position on the substrate relative to reference marks on the substrate, and the amount of product to be projected. A software package in memory 66 controls the machine of FIG. 1 to exploit this information by expressing the information in parameters of relative displacement of substrate 23 and nozzle array 46, in parameters for selectively controlling the nozzles and in parameters for reiterating a shifted passage of the substrate in front of the nozzles in order to produce joined lines if required.

In other exemplary embodiments, the machine of FIG. 1 can be modified to include additional work stations which, for example, assemble various parts together, e.g., applying an adhesive on determined contact to areas of the substrates.

Each of the ink-jet nozzles of array 46 is electro-acoustically driven by a piezoelectric actuator of array 47. The piezoelectric actuators are activated by a particular electric waveshape derived by electric source 80, in turn responsive to an output of interface 54 which indicates the shape of a voltage wave that source 80 applies to the piezoelectric actuators. The shape of the voltage wave and the droplet depend on the waveform information stored in memory 66 which is read out to electric source 80 in response to at least one of the following parameters: viscosity of the ink droplets, temperature of the ink droplets, temperature of the substrate, desired thickness of the layer, type of substrate surface to which the droplets are applied, temperature of the substrate, and relative speed of the substrate and the ink jet nozzle array.

Figure 2:
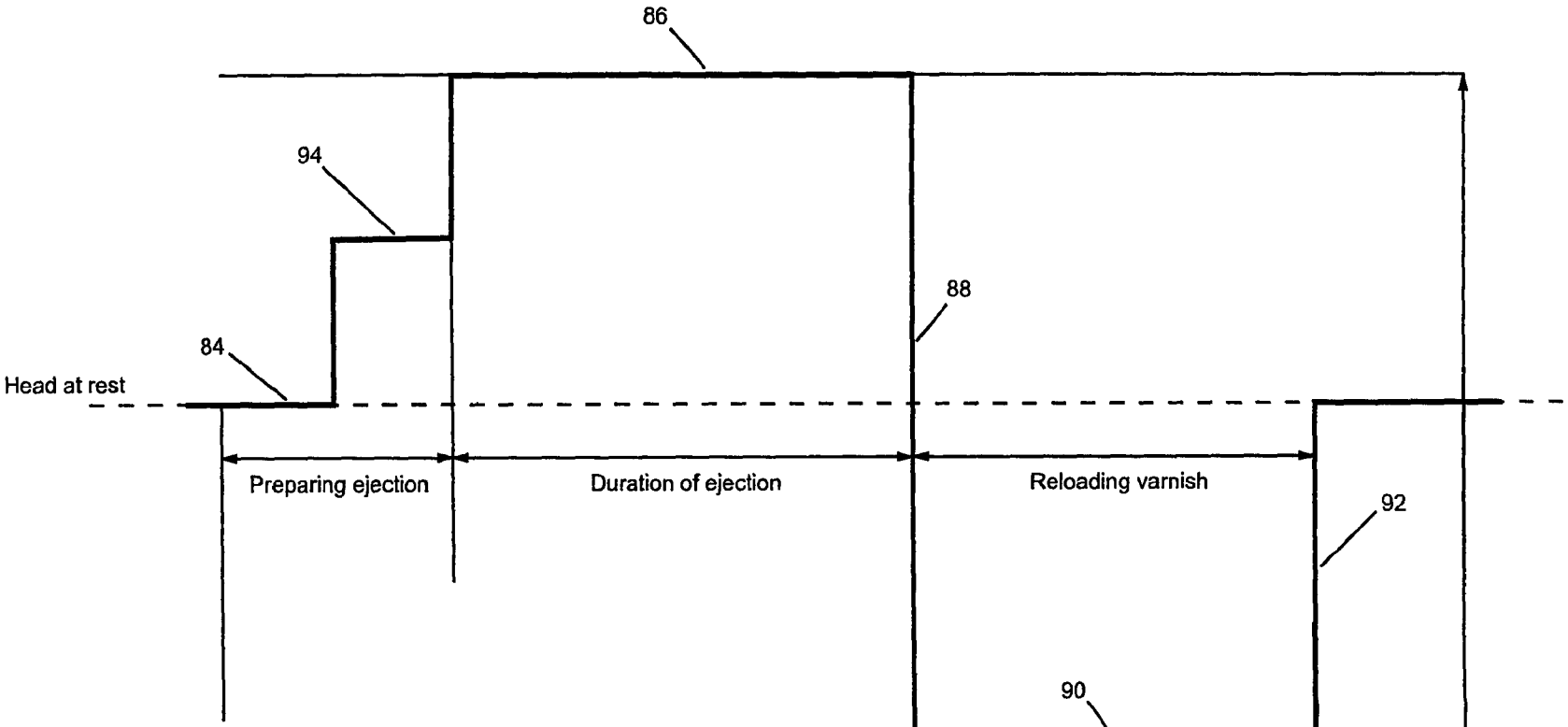
FIG. 2 is a diagram of an exemplary voltage waveform applied to the piezoelectric actuator of FIG. 1, for controlling the shape of ink droplets supplied by the ink-jet nozzles of FIG. 1 to form the protective layer on the substrate for expelling coverage ink, generated by the piezoelectric actuator of at least one nozzle of the printing device of the invention.

The shape of the voltage wave which source 80 applies to actuator array 47 ensures expulsion of the correct quantity of ink and its deposition on substrate 23. The voltage wave (FIG. 2) has a rising portion 82 from a neutral voltage value 84, corresponding to a rest condition of a nozzle, to a peak positive value which forms a phase plateau 86. Plateau 86 corresponds with the ejection phase of the ink loaded in the nozzle. The intensity of the actuator of array 47 which drives the nozzle then changes in proportion to the voltage amplitude of plateau 86 above neutral value 84. During plateau 86 the volume of the nozzle expands by an amount proportional to the amplitude of plateau 86; the expansion is for a period substantially equal to the duration of plateau 86 so that the diameter and duration of the droplet are controlled. As a result the droplet shape and therefore droplet volume are controlled.

The voltage derived by source 80 then has a polarity inversion 88 to a voltage having a negative polarity relative to neutral value 84. The negative polarity voltage has a plateau 90 having an amplitude and duration enabling the nozzle to be reloaded with ink from manifold 44. The duration and amplitude of both of plateaus 86 and 90 are usually the same and in the range of 1 to 100 microseconds and 5 to 100 volts (preferably 10 to 50 volts) to to achieve optimum operation. According to a preferred embodiment, the duration of plateau 90, during which the ink is reloaded from manifold 44 into the nozzle, is equal to that of plateau 86, during which the ink is ejected from the nozzle. Upon completion of plateau 90, the voltage source has a rising edge 92 so the voltage source 80 returns to neutral value 84. Data stored in memory 66 are such that the amplitude and/or duration of plateaus 86 are greater for inks having high viscosity than for ink having low viscosity. As ink temperature increases the inks usually become less viscous, so that the data stored in memory 66 are such that as ink temperature increases there are decreases in the amplitude and/or duration of plateaus 86.

Rising voltage waveform portion 82 preferably has an intermediate amplitude at plateau 94 between the amplitudes of neutral value 84 and plateau 86. Plateau 94 enables the ink to be prepared for ejection before the actual expulsion during plateau 86. According to a particular embodiment, the voltage amplitude of intermediate plateau 94 is typically about one-half the voltage amplitude of plateau 86 and the duration of plateau 94 is in the range of 60 nanoseconds to 10 microseconds (preferably between 100 nanoseconds and 1 microsecond). The voltage amplitude and duration of plateau 94 depend on the viscosity of the ink so that increases in viscosity are accompanied by increases in voltage amplitude and duration of plateaus 94. Plateau 94 enables reloading of the varnish in the nozzle by providing pauses during the loading to avoid an upward flow of air into the nozzle from its expulsion orifice.

According to one embodiment, the rising portion 82 can have several intermediate plateaus for loading ink. The number, voltage amplitude and duration of each of these plateaus are a function of the ink viscosity. According to a particular embodiment, the succession of intermediate plateaus have progressively reduced durations, leading to the formation of an increasing, continuous and gradual loading of the varnish in the nozzle, which may have the aspect of a curve or of a straight line. Ideally, the varnish used has a viscosity from 4 to 100 mPa·s. According to another particularity, the voltage amplitude(s) of the plateau(s) are also determined by the type of detected substrate used during deposition by nozzles of the protective layer.

CPU 52 monitors and adjusts the values and durations of the different plateaus of the wave that source 80 derives and therefore of the shape of the ink droplet depending on at least one printing parameter, for example a characteristic of the substrate or of the ink intended to be deposited on the substrate surface. This characteristic may for example be the viscosity of the ink, as derived in detector 58; the temperature of the ink, as derived by detector 60 or of the substrate, as derived by detector 62; the type of surface on which the ink is projected (e.g., the stiffness and/or chemical composition of the substrate), the sought final quality; or the velocity of the substrate passing under the nozzle, as derived by detector 64. The outputs of one or more of detectors 58, 60, 62 and 64 can be supplied to interface 54 to provide partial or completely automatic control of the shape of the wave that source 80 derives. Alternatively, outputs of the detectors can be observed by an operator who loads them via keyboard 56 into memory 66 via interface 54. As a further alternative, the operator can, in certain instances, assume that viscosity and some other parameters will not be subject to change and enter predetermined values into memory 66 via keyboard 56.

Memory 66 has one or more databases including information about the waveforms source 80 derives, such as the voltage amplitudes and durations of the plateau(s), the numbers of plateaus, and/or possible ratios of the heights of these plateaus, including the values of these characteristics which are correlated with one or more of the printing parameters. According to a preferred embodiment, the parameters which are mainly taken into account for regulating the foregoing characteristics of the waveforms are the viscosity and/or the composition of the ink used and/or of the substrate intended to be covered.

Each of the nozzles of array 46 includes a resistive heater 46 which is connected to temperature controller 96, in turn responsive to an output of interface 54 indicative of the ink viscosity. Consequently, the temperature of the ink drops is controlled and regulated, and is therefore based on its viscosity. A resistive heater 45 is housed in each of the nozzles of array 46 upstream of the ejection orifice of the nozzle. Memory 66 also has a database including at least one predefined temperature value for each resistive heater 45 to obtain a particular viscosity value of the ink at the outlet of the nozzle. This temperature value depends on the composition of the ink to be deposited, which is pre-recorded in memory 66. This correlation between a temperature value required for the resistive heater 45 and the composition of a particular ink can be obtained, for example, via memory 66 storing a table based on a mathematical function relating the viscosity of the ink having a determined composition to a temperature value. This temperature in the nozzles is typically between 10 and 50° C.

Memory 66 can be pre-programmed by an operator via keyboard 56 and interface 54 through which the operator defines the ink and/or the substrate used. Alternatively, information about the ink and/or substrate can be read into memory 66 in response to outputs of detectors 58-64 which conduct measurements enabling detection of one or more parameters required for selecting the shape or a characteristic of the waveform that source 80 derives. As a further alternative, memory 66 stores desired values for the temperatures to which resistive heaters 54 heat the ink in the nozzles, so that the ink has a viscosity in a defined range or even at a particular value. Detectors 58 and 60 can be replaced by individual detectors in flow paths in manifold 44 leading directly to each of the nozzles in array 46 so the detectors are positioned immediately upstream of the resistive heater 45 in each nozzle relative to the direction of displacement of the ink in the printing nozzles. Positioning the temperature and viscosity detectors downstream of the resistive heaters 45 would only allow adjustment of the wave derived by source 80 after a first deposition of ink has already been carried out. Positioning the temperature and viscosity detectors upstream of the resistive heaters allows adjustments of the wave derived by source 80 without the need of carrying out a first "test" deposition of ink.

The printing device of FIG. 1 is likely to employ inks which include in their composition at least one photo-initiator for activating polymerization of the ink. Such photoinitiators are generally activated by radiation having one or more particular wavelengths which cause formation of one or more free radicals. The activating wavelengths are typically of ultraviolet (UV) radiation. The machine of FIG. 1 therefore includes one or more UV lamps 32 located downstream of the printing nozzles of array 47 in the displacement direction of substrate 23. Preferentially, the wavelengths of the UV lamp are of the order of 200-400 nm. The wavelength depends on the type of photo-initiator(s) in the composition of the ink deposited on substrate 23.

The printing device of FIG. 1 also comprises a drying station 34 with one or more infrared (IR) radiation lamps which carry out pre-drying of the deposited ink. Drying station 34 is downstream of nozzle array 46 and upstream of UV source 34 at a position determined by the expected forward speed of substrate 23. Station 34 is transversely spaced from the substrate at predefined optimum distance depending on at least one characteristic of the deposited ink and on the type of substrate to be covered. These pre-drying parameters are stored in a memory 66.

The IR lamps of drying station 34 have emissions in different wavelength regions. The power for each of the lamps is controlled and regulated by a device adapted for managing the combination of the radiations of the lamps. The managing device is associated with CPU 50 and memory 66 that includes programming of the radiation specific to each lamp depending on the type of covered substrate and/or at least one characteristic of the deposited ink. According to a particular embodiment, the lamps of drying station 34 irradiate the substrate with wavelengths between 0.5 and 8 μm.

If station 34 derives a pair of wavelengths, short wavelengths, between 0.5 and 3.2 μm, and medium wavelengths, between 1.6 and 8 μm, are incident on substrate 23. The combination of the wavelengths for a substrate of the printed paper type relies on a power of the order of 100% for the medium wavelengths and on a power of the order of 50% for the short wavelengths. Also, the combination of IR wavelengths for a plastic type substrate requires a power of the order of 80% for medium wavelengths and on very low or even zero power for short wavelengths.

FIG. 1 also includes a system 98 for checking the plotting of the areas intended to be printed. System 98, which includes a readout station (not shown) which reads and determines the position of the areas to be covered, is driven by electromechanical processes so that a rectification guide follows a rectification line and ensures substantially perfect location between the printed substrate and a new printed area. This rectification line has a strong contrast, is ideally black, and printed with the printing pattern of the substrate, that is, so-called background printing. The readout station uses this rectification line as a reference for computing a side shift relative to the direction of displacement of the substrate relative to the nozzles which deposit the ink. From the measured shift, the rectification guide corrects the trajectory by modifying it accordingly so that the rectification line remains strictly centred with the readout system.

It should be obvious for persons skilled in the art that the present invention allows embodiments under many other specific forms without departing from the field of application of the invention as claimed. Therefore, the present embodiments have to be considered as an illustration but they may be modified within the field defined by the scope of the appended claims. For example, the ink-jet nozzle arrangement can be one or more ink-jet nozzles that scan from edge to edge or the illustrated stationary array of ink-jet nozzles.

The invention claimed is:

1. A method of applying a coating of covering ink to a substrate moving relative to an ink jet nozzle arrangement having a piezoelectric actuator for applying droplets of covering ink to the substrate, the method comprising controlling by a computer the shapes of the droplets by controlling the shape of an electric waveform applied to the piezoelectric actuator, in response to at least one of the viscosity and/or the temperature of the ink, detected as the ink flows from the ink container to the nozzle by at least one detector upstream from a heater included in the nozzle arrangement.

2. The method of claim 1 wherein the parameter includes temperature of the substrate.

3. The method of claim 1 wherein the parameter includes thickness of the coating.

4. The method of claim 1 wherein the parameter includes relative speed of the substrate and the ink jet nozzle arrangement.

5. The method of claim 1 wherein the parameter includes type of substrate surface to which the droplets are applied.

6. The method of claim 5 wherein the substrate surface type parameter includes chemical composition of the substrate and/or stiffness of the substrate.

7. The method of claim 1 wherein the waveform has (a) neutral value associated with the nozzle arrangement being at rest, (b) a first polarity relative to the neutral value for causing the nozzle arrangement to have a volume greater than the neutral value, and (c) a second polarity relative to the neutral value for causing the nozzle arrangement to have a volume less than the neutral value; the waveform first polarity having an intermediate substantially constant amplitude between the neutral value and a peak value, each peak value causing a droplet to be expelled from the nozzle arrangement, the intermediate value having an amplitude and/or duration to dependent on the viscosity of the ink droplet.

8. The method of claim 1 further including maintaining the temperature of the covering ink at a predetermined temperature within the ink jet nozzle arrangement by said heater.

9. The method of claim 1 wherein the ink includes a photoinitiator and further including irradiating the covering ink applied to the substrate with radiation that activates the photoinitiator.

10. The method of claim 1 wherein the parameter includes the viscosity of the droplet of covering ink at the outlet of the nozzle.

11. The method of claim 1 wherein the parameter includes viscosity of the covering ink measured by a probe upstream from the piezoelectric actuator and/or from a heater heating the covering ink.

12. Apparatus for applying a coating of covering ink to a substrate, comprising a transport mechanism for causing relative movement between the substrate and an ink jet nozzle arrangement, the ink jet nozzle arrangement having a piezoelectric actuator for applying droplets of covering ink to the substrate; a computer controlling a heater included in the nozzle arrangement heating the covering ink and an electric source for applying an electric waveform to the piezoelectric actuator, said waveform controlling the shapes of the droplets, said electric waveform having a shape determined by at least one of the viscosity and/or the temperature of the covering ink, the apparatus further including at least one detector upstream from the heater for detecting the viscosity of the ink and/or a detector for detecting temperature of the ink droplets as the ink flows from the ink container to the nozzle.

13. The apparatus of claim 12 wherein the parameter includes temperature of the substrate, and further including a detector for detecting temperature of the substrate.

14. The apparatus of claim 12 wherein the parameter includes desired thickness of the coating.

15. The apparatus of claim 12 wherein the parameter includes relative speed of the substrate and the ink jet nozzle arrangement.

16. The apparatus of claim 12 wherein the parameter includes type of substrate surface to which the droplets are applied.

17. The apparatus of claim 16 wherein the substrate surface type parameter includes chemical composition of the substrate and/or stiffness of the substrate.

18. The apparatus of claim 12 wherein the waveform has (a) neutral value associated with the nozzle arrangement being at rest, (b) a first polarity relative to the neutral value for causing the nozzle arrangement to have a volume greater than the neutral value, and (c) a second polarity relative to the neutral value for causing the nozzle arrangement to have a volume less than the neutral value; the waveform first polarity having an intermediate substantially constant amplitude between the neutral value and a peak value, each peak value causing a droplet to be expelled from the nozzle arrangement, the intermediate value having an amplitude and/or duration dependent on the viscosity of the ink droplet.

19. The apparatus of claim 12 further including a temperature detector for the ink flowing to the ink jet nozzle arrangement, and a temperature controller responsive to the temperature detector, the temperature controller being arranged for controlling the temperature of the ink flowing in the ink jet nozzle arrangement, wherein the computer controls the heater via the temperature controller.

20. The apparatus of claim 12 further including a memory storing information associated with the shapes of a plurality of the waveforms, an interface for controlling readout of said information in the memory in response to at least one of the parameters being entered into the interface, and a controller arranged to be responsive to the information readout of said memory for controlling the electric source for causing the electric source to derive a waveform having a shape determined by the readout information.

21. The apparatus of claim 20 wherein the interface includes a detector machine interface for enabling a detector arrangement for at least one of the following parameters to enter at least one of the following parameters into the interface; viscosity of the covering ink, temperature of the covering ink, temperature of the substrate, and relative speed of the substrate and the ink jet nozzle arrangement.

22. The apparatus of claim 21, wherein the interface includes an operator memory interface for enabling an operator to enter at least one of the parameters into the interface.

23. The apparatus of claim 20, wherein the interface includes an operator memory interface for enabling an operator to enter at least one of the parameters into the interface.

24. The apparatus of claim 12 wherein the parameter includes the viscosity of the droplet of covering ink at the outlet of the nozzle.

25. The apparatus of claim 12 wherein the parameter includes viscosity of the covering ink measured by a probe upstream from the piezoelectric actuator.

* * * * *